US010898824B1

(12) United States Patent
Meno

(10) Patent No.: US 10,898,824 B1
(45) Date of Patent: Jan. 26, 2021

(54) CONFETTI LAUNCHER

(71) Applicant: JFL Enterprises, Inc., Cleveland, OH (US)

(72) Inventor: Joseph Meno, Avon Lake, OH (US)

(73) Assignee: JFL Enterprises, Inc., Cleveland, OH (US)

( * ) Notice: Subject to any disclaimer, the term of this patent is extended or adjusted under 35 U.S.C. 154(b) by 0 days.

(21) Appl. No.: 16/708,967

(22) Filed: Dec. 10, 2019

Related U.S. Application Data

(60) Provisional application No. 62/928,409, filed on Oct. 31, 2019.

(51) Int. Cl.
*A63H 37/00* (2006.01)
*F41B 7/00* (2006.01)

(52) U.S. Cl.
CPC ..... *A63H 37/00* (2013.01); *F41B 7/00* (2013.01)

(58) Field of Classification Search
CPC ..... A63H 37/00; F41B 7/00
See application file for complete search history.

(56) References Cited

U.S. PATENT DOCUMENTS 3,586,320 A 6/1971 Mace
5,015,211 A * 5/1991 Reveen ..... A63H 37/00 124/74
5,149,290 A * 9/1992 Reveen ..... A63H 37/00 124/74
5,954,563 A * 9/1999 Spriggs ..... F42B 4/22 102/357
6,312,310 B1 * 11/2001 Sterr ..... A63H 37/00 446/475
6,796,872 B2 * 9/2004 Herber ..... A63H 13/16 446/308
7,350,477 B1 4/2008 Tilford et al.
8,944,088 B2 * 2/2015 Gilmer ..... F16K 17/406 137/76
2006/0054152 A1 * 3/2006 Ambrico ..... A63H 5/04 124/71
2019/0046893 A1 2/2019 Ming et al.

FOREIGN PATENT DOCUMENTS

KR 20100064507 12/2008

* cited by examiner

*Primary Examiner* — John A Ricci
(74) *Attorney, Agent, or Firm* — Ladas & Parry LLP

(57) ABSTRACT

A novelty device in the form of a confetti launcher intended for placement on a food product, such as a cake, has a base supporting a generally upright confetti launch tube. A plunger is mounted for travel within the launch tube from a first lower pre-launch position to a second post-launch position. The plunger is retained in the pre-launch position by a release mechanism, which is activated by a lit fuse severing a cord of the release mechanism.

5 Claims, 4 Drawing Sheets

CONFETTI LAUNCHER

The present invention is directed to a novelty device intended to be placed on a dessert item, such as a cake, and more particularly an occasion cake, such as a birthday cake.

BACKGROUND

Celebratory novelty items are known and a popularly used to provide adornment and interest to an appropriate celebratory item, such as a birthday cake. For example, the "Incredible Candle" is a display piece placed on a cake. It holds a plurality of candles within closed "petals" of a flower. When the candles are lit, the flower's petals open, fully exposing the candles.

Applicant's co-pending application for a confetti launcher is directed to a launcher comprising a rotating housing having a plurality of launching tubes for confetti loaded into the tubes. Upon activation the housing rotates, sequentially activating the launchers. A musical tune can be played as the housing rotates, and provision is made for the simultaneous elevation of a central candle.

While the aforesaid launcher provides a unique and highly enjoyable action sequence, there is a need for a less complicated novelty item which provides a similar launching action.

BRIEF DESCRIPTION OF THE INVENTION

The present invention is a single barrel confetti launcher. It comprises a generally upright launching tube cylinder that is loaded with confetti, which is launched upwardly out of the tube once the launcher is activated. The confetti sits on a spring-loaded plunger which is retained in a cocked position within the tube by a release mechanism. Activation is performed by lighting a fuse that extends outwardly from the base of the device, which in turn triggers the release mechanism. The plunger quickly travels upwardly within the tube, shooting the confetti out of the tube, to fall gently down.

BRIEF DESCRIPTION OF THE DRAWINGS

A fuller understanding of the invention will be obtained upon consideration of the following detailed description of an illustrative embodiment of the invention, when reviewed in connection with the annexed figures, wherein.

DETAILED DESCRIPTION OF THE INVENTION

Figure 1:
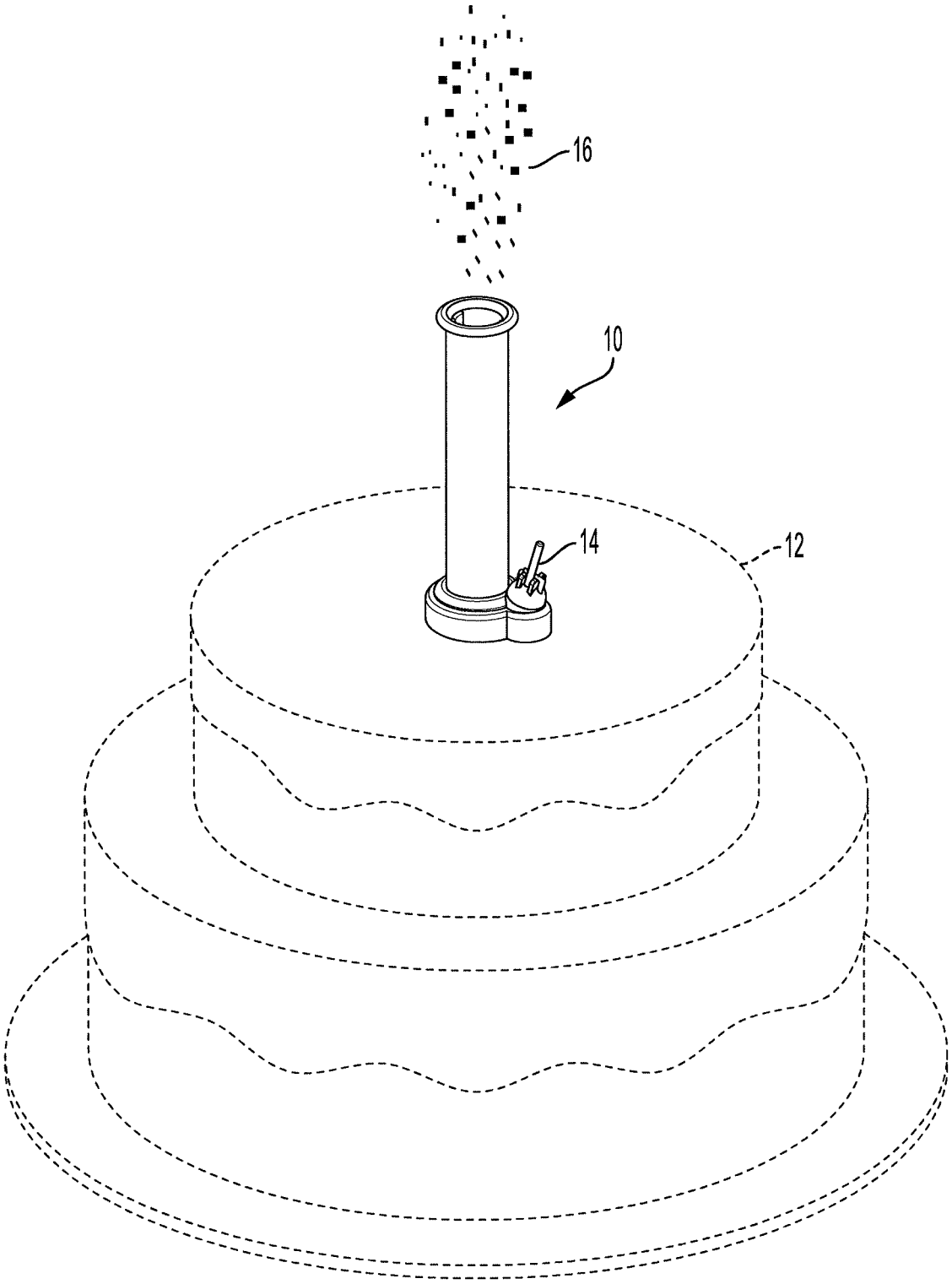
FIG. 1 is a perspective view of a launcher of the present invention in place on a cake.

With initial reference to FIG. 1, confetti launcher 10 is intended to sit upon an appropriate supporting object, such as cake 12. When operated, ignition of fuse 14 causes the launcher to be activated, allowing confetti 16 to be ejected from the upper open end of launch tube 18. In is to be appreciated that, depending on the specific nature of fuse 14, the fuse may disintegrate upon its burning. The confetti, which may be of paper or plastic pieces as known in the art, or small edible pieces, such as candy bits, shoot upward and fall back down around the launcher.

Figure 2:
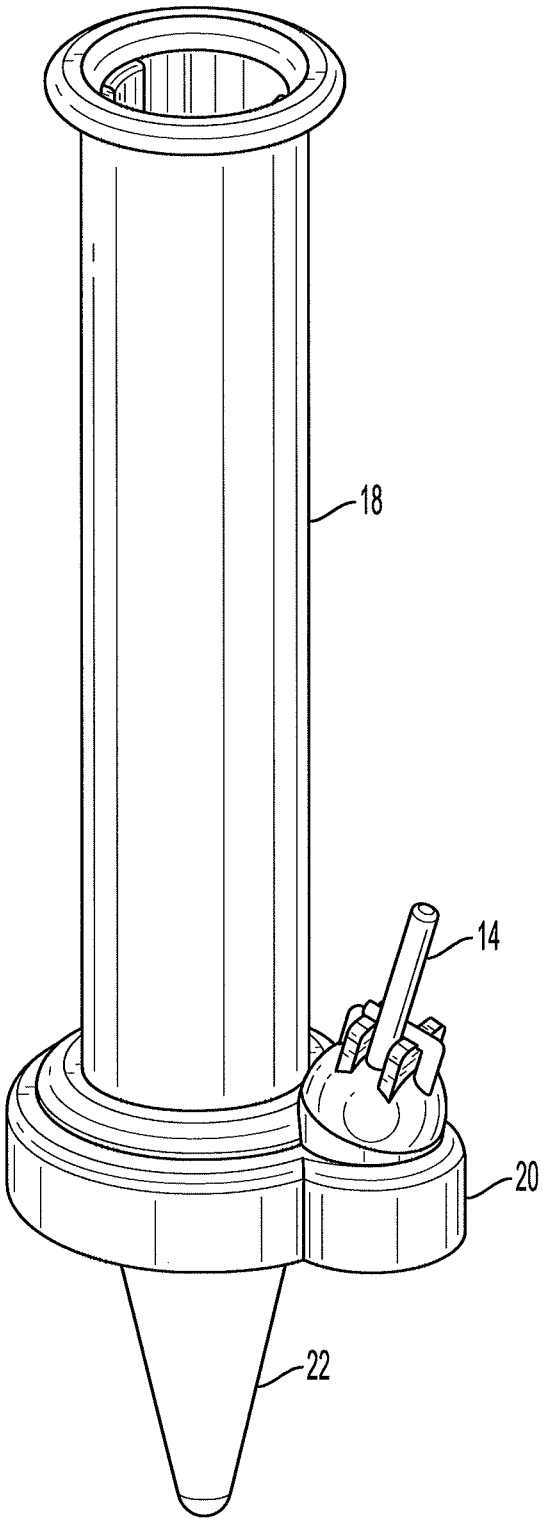
FIG. 2 is an enlarged perspective view of the launcher of FIG. 1 detailing the fuse and the exposed portion of the release mechanism.
Figure 3:
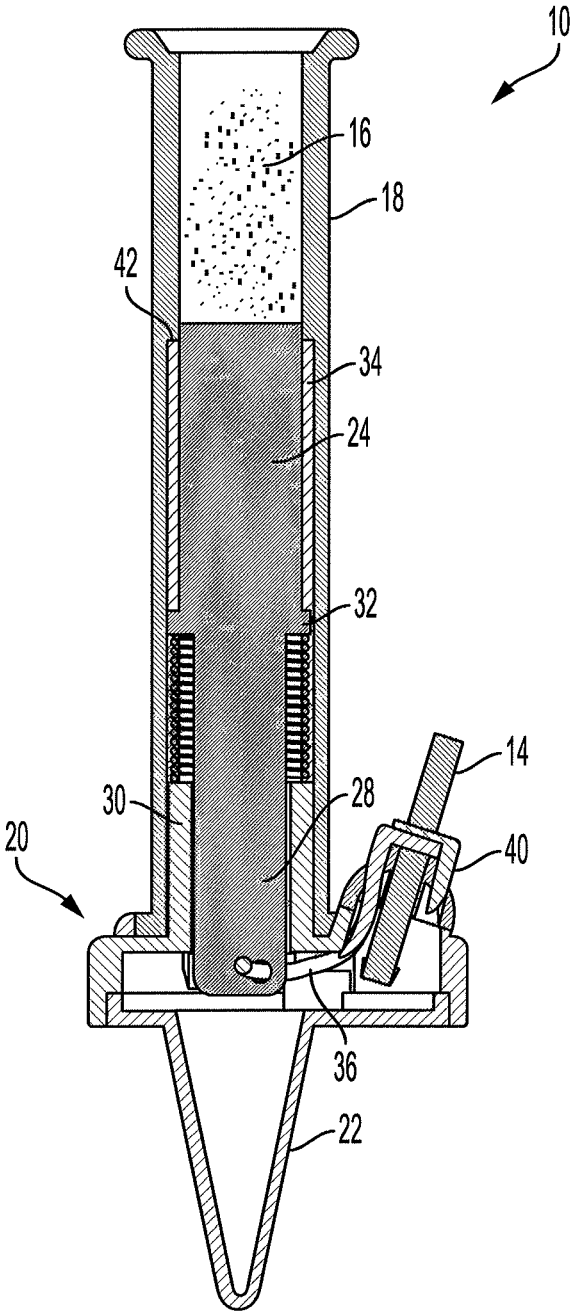
FIG. 3 is a cross-sectional view of the launcher of FIG. 1 with the plunger in the initial cocked position.
Figure 4:
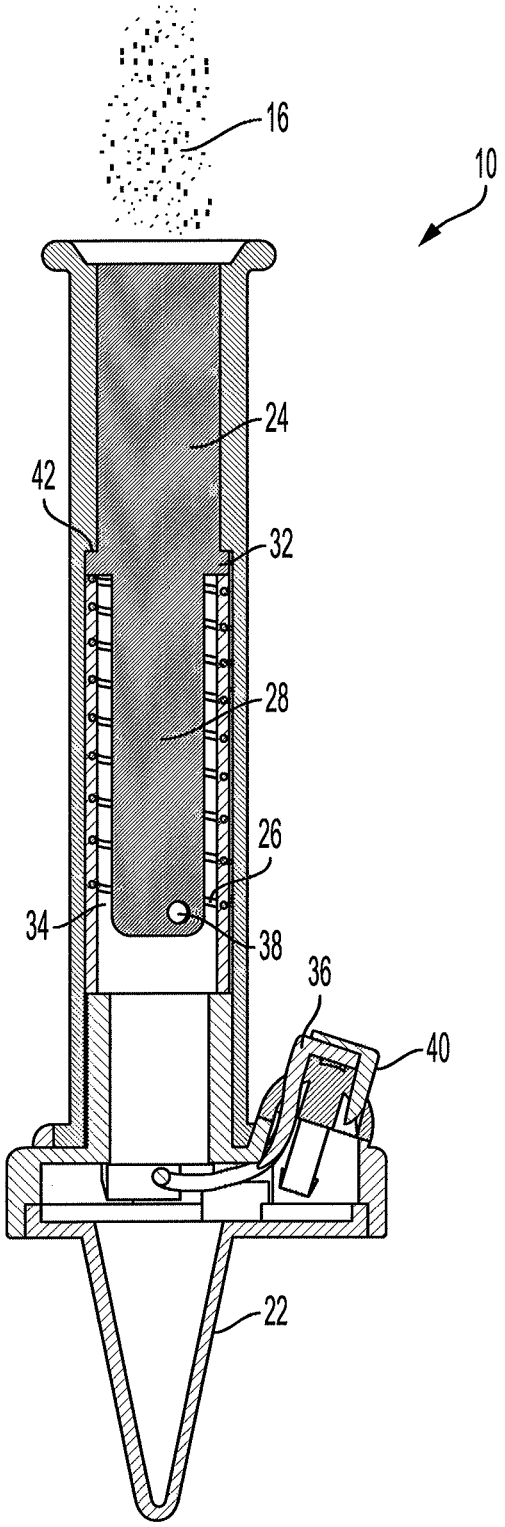
FIG. 4 is a cross-sectional view of the launcher of FIG. 1 after launch of confetti.

Referring more specifically to FIGS. 2 through 4, launching tube 18 extends upwardly from base 20. Base 20 includes downwardly-extending conical mounting wedge 22 which is inserted into the object, such as cake 12. The wedge supports the launcher 10 in the desired position.

Launching tube 18 carries plunger 24, adapted to travel upward from its initial pre-activation position as depicted in FIG. 3 to the after-launch position as depicted in FIG. 4 under the influence of spring 26. Spring 26 sits on pedestal 30 of the base, encircles the lower portion 28 of plunger 24, and exerts its spring force between the pedestal and the lower surface of collar 32 of the plunger, which is of a greater diameter than the portion of the plunger above the collar. Collar 32 rides in the lower portion 34 of the launch tube, the upper end of which provides a stop for the collar and thus the plunger when activated. As seen in FIGS. 3 and 4, portion 34 has an inner diameter sufficient to accept the collar, terminating at its upper end 42 by a section of the tube of a lesser diameter to accept only the portion of the plunger above the collar, producing a stop for the plunger, seen in FIG. 4. The length of the plunger is such that its upper end extends into the lesser diameter section even when the plunger is in the pre-activation position of FIG. 3, such that the plunger is guided along its path of travel by the lesser diameter portion.

The plunger is retained in the initial pre-activation by a release mechanism, which may comprise string or cord loop 36 in the open interior of the base which passes through bore 38 in the lower portion 28 of plunger 24. The string passes outwardly through a first bore in hemispheric launch cap 40 located on the base to place the exposed portion of the string in close proximity to, and preferably in contact with, the fuse, and then loops back into the base through another bore. The string loop is taut and strong enough to hold the plunger in the cocked position against the force of the compressed spring 26. The loop may be formed by passing an end of a length of string through the bore 38, threading it into the launch cap and across the string guides and then back into base. Appropriate tension is applied to the string to hold the plunger in the cocked position and the ends of the string tied together. Any additional length of free string beyond the tying knot may be trimmed off.

Fuse 14 is mounted in a bore in the launch cap, which positions the fuse in contact with the exposed portion of the string, as best seen in FIG. 2. When the fuse is lit, it burns down and burns through the string. With the string severed and its loop broken, the plunger is no longer retained in the initial position, and thus shoots upward by spring 26, ejecting the confetti from the launch tube. The time it takes for the fuse to burn down and sever the string provides a delay from lighting and can provide a degree of suspense as to what is to happen, culminating in the release of the confetti.

The launch tube, plunger and base may all be fabricated from an appropriate plastic or like material, as known in the art. The fuse may be of a type generally known in the art for use in novelty devices, and may typically include single base powder, moisture proof glue and an oxidant. The string or cord may likewise be as known in the art, and may preferably be a cotton thread.

I claim:

1. A confetti launcher, comprising a base supporting a generally upright confetti launch tube; a plunger mounted for travel within the launch tube from a first lower prelaunch position to a second post-launch position; a spring for driving the plunger from the prelaunch position to the post-launch position, and a fuse-activated release for the plunger, the release comprising a cord positioned for severing by burning of the fuse, the fuse serving as a delay timer for the release, the cord having an initial state in the form of a taut closed loop that passes through a bore in the plunger with the plunger in the pre-launch position.

2. The confetti launcher of claim 1 wherein the fuse is mounted in a bore in a launch cap located on the base, and the cord loop includes a portion on the exterior of the launch cap adjacent the fuse.

3. The confetti launcher of claim 1 wherein the plunger includes an upper section of a first diameter and a collar positioned below the upper section of a second; larger diameter, the launch tube having a first section with an inner diameter to accept the collar of the of plunger and a second section, positioned above the first section, with an inner diameter to accept the first section of the plunger but not the collar.

4. The confetti launcher of claim 3 wherein the first and second sections of the launch tube intersect at a point that provides a stop for upward travel of the plunger.

5. The confetti launcher of claim 3 wherein the spring is positioned between a pedestal of the base and the collar.

* * * * *